US008579733B2

(12) United States Patent
McGrath

(10) Patent No.: US 8,579,733 B2
(45) Date of Patent: Nov. 12, 2013

(54) DIRECT PRIZE-DISPENSING GAME WITH CRANE DISPENSER

(75) Inventor: Christopher John McGrath, Wights Mountain (AU)

(73) Assignee: LAI Games Australia Pty Ltd, Northbridge, WA (AU)

( * ) Notice: Subject to any disclaimer, the term of this patent is extended or adjusted under 35 U.S.C. 154(b) by 283 days.

(21) Appl. No.: 12/774,593

(22) Filed: May 5, 2010

(65) Prior Publication Data

US 2011/0272887 A1 Nov. 10, 2011

(51) Int. Cl.
*A63F 9/00* (2006.01)
*A63F 9/34* (2006.01)

(52) U.S. Cl.
USPC ..... 473/448; 473/447

(58) Field of Classification Search
USPC ..... 273/440, 447, 448, 453–454, 459, 461; 463/5, 7, 36–57
See application file for complete search history.

(56) References Cited

U.S. PATENT DOCUMENTS

| | | | | |
|---|---|---|---|---|
| 5,397,134 | A * | 3/1995 | Fishman et al. | 463/25 |
| 5,711,530 | A * | 1/1998 | Lewis | 273/448 |
| 6,139,429 | A * | 10/2000 | Shoemaker, Jr. | 463/7 |
| 6,152,447 | A * | 11/2000 | Stanley | 273/138.1 |
| 6,634,940 | B2 * | 10/2003 | Yoshida et al. | 463/7 |
| 6,899,337 | B2 * | 5/2005 | Fisher et al. | 273/447 |
| 7,604,238 | B2 * | 10/2009 | Verstraeten | 273/448 |
| 7,918,458 | B2 * | 4/2011 | Fukazawa et al. | 273/448 |
| 2007/0029734 | A1 * | 2/2007 | Fukazawa et al. | 273/447 |

* cited by examiner

*Primary Examiner* — Nini Legesse
(74) *Attorney, Agent, or Firm* — Fulbright & Jaworski LLP

(57) ABSTRACT

A direct prize-dispensing game dispenses prizes using a crane assembly under control of the game player. The player participates in an underlying game of the prize-dispensing game that is independent from the prize dispensing function of the crane assembly. When the player successfully achieves an object of the game entitling the player to a prize, the prize-dispensing game switches player control to the crane assembly for dispensing an associated prize selection. The player then controls the crane assembly to select a desired prize. The prize-dispensing game keeps the controls to the crane assembly until a prize is dispensed to the player.

8 Claims, 4 Drawing Sheets

DIRECT PRIZE-DISPENSING GAME WITH CRANE DISPENSER

TECHNICAL FIELD

The present teachings relate, in general, to prize-dispensing games, and, more particularly, to a direct prize-dispensing game with a crane dispenser.

BACKGROUND

Direct prize-dispensing games are popular entertainment machines that are commonly found in arcades, malls, retail stores, theaters, restaurants, bars, theme parks, and other locations with large concentrations or high traffic of people. These machines typically display objects, such as stuffed animals, trinkets, electronic devices, and other desirable prizes, inside a game cabinet and are clearly visible to those who pass by. Usually, these objects are offered as prizes to a player who wins or accomplishes some predetermined objective of the game. Typically, a player will insert a game credit, which may be some form of monetary credit, token, or the like to play the game. The player then plays the game and attempts to accomplish the predetermined objective in order to win the game. If the player is successful, a prize is typically immediately awarded to the player through a door or compartment in the game cabinet. When the objective is achieved, the game mechanism operates to release one of the prizes to a chute or pathway that leads to this compartment in the game cabinet.

BRIEF SUMMARY

The various embodiments of the present teachings are directed to a direct prize-dispensing game in which prizes are dispensed by using a crane assembly under control of the game player. The player participates in an underlying game of the direct prize-dispensing game that is independent from the crane assembly. When the player successfully achieves an object of the game entitling the player to win a prize, the direct prize-dispensing game switches player control to the crane assembly, which then becomes the mechanism to dispense the prize to the player. The player then controls the crane assembly to select and grab the desired prize. There is no skill involved in order for the player to claim the prize, and the crane mechanism is operated merely as a dispensing tool with which the player interacts and manipulates to choose from a selection of prizes on display. If the player fails to successfully pick up a selected prize, the game keeps the controls with the crane assembly until a prize is dispensed to the player.

Representative embodiments of the present teachings are directed to methods for dispensing a prize in a direct prize-dispensing game. These methods include monitoring a game status of an active game on the direct prize-dispensing game, and switching player control of the direct prize-dispensing game to a crane apparatus associated with the direct prize-dispensing game, responsive to the game status indicating a player is entitled to the prize. These methods also include positioning the crane apparatus according to directional input received from the player, securing the prize in the crane apparatus in response to deployment input received from the player, and dispensing the secured prize to the player.

Further representative embodiments of the present teachings are directed to direct prize-dispensing games that include a housing structure, a game apparatus within the housing structure, and a crane assembly within the housing structure, wherein the crane assembly dispenses a prize to a player successfully achieving an object of the game apparatus, and wherein movement of the crane assembly in selecting the prize is controlled by the player.

Still further representative embodiments of the present teachings are directed to direct prize-dispensing games that include a housing structure, and a game screen within the housing structure, where the game screen is configured to display a game to a player. The direct prize-dispensing games also include a crane assembly within the housing structure, where the crane assembly is configured to move around the housing structure responsive to player input and further configured to retrieve prizes located within the housing structure. The direct prize-dispensing games also include player controls associated with the housing structure which are accessible to the player. These direct prize-dispensing games further include a processing unit within the housing structure, a memory within the housing structure and coupled to the processing unit, and game logic stored on the memory. When executed by the processing unit, the game logic presents a game to the player on the game screen and runs the game responsive to player input received through the player controls. The direct prize-dispensing games also include prize dispensing logic stored on the memory. When executed by the processing unit, the prize dispensing logic switches control of the player controls to the crane assembly responsive to the player successfully achieving an object of the game, wherein control of the crane assembly remains until the prize is dispensed to the player.

The foregoing has outlined rather broadly the features and technical advantages of the present teachings in order that the detailed description that follows may be better understood. Additional features and advantages will be described hereinafter which form the subject of the claims. It should be appreciated by those skilled in the art that the conception and specific embodiments disclosed may be readily utilized as a basis for modifying or designing other structures for carrying out the same purposes of the present teachings. It should also be realized by those skilled in the art that such equivalent constructions do not depart from the technology of the teachings as set forth in the appended claims. The novel features which are believed to be characteristic of the teachings, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present teachings.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Figure 1:
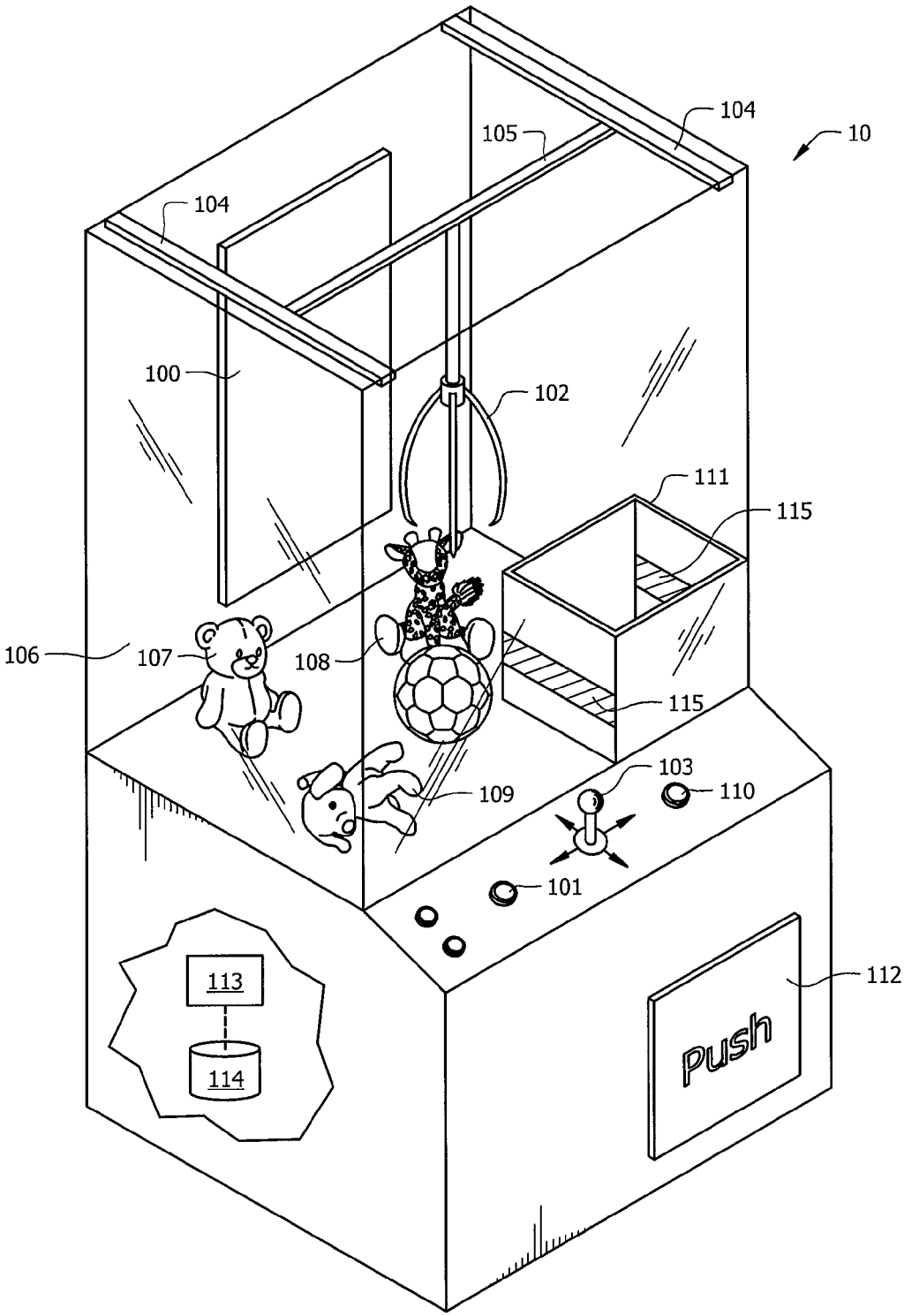
FIG. 1 is a diagram illustrating a direct prize-dispensing game configured according to one embodiment of the present teachings.

In playing a direct prize-dispensing game, the game play ends or is, at least, suspended when the player wins or loses. When the player wins, the game play is stopped or suspended while the game unit dispenses or redeems the resulting prize. Instead of simply ending or suspending game play during such situations, it may be beneficial to include additional interactive entertainment even after the player successfully achieves the predetermined objective of the underlying game. FIG. 1 is a diagram illustrating direct prize-dispensing game 10 configured according to one embodiment of the present teachings. Direct prize-dispensing game 10 includes game screen 100 and game control 101. When participating in the game, the player provides game input through game control 101 and is able to view the associated game progress on game screen 100. The prizes for the game, prizes 107-109, are placed in prize area 106 of direct prize-dispensing game 10. Prize area 106 provides a fully visible container in which a player may see and decide on a prize that he or she may desire should he or she successfully achieve the objective of the game.

Direct prize-dispensing game 10 also includes crane arm 102 and crane controls 103 and 110. When the player successfully achieves the objective of the game, the player is able to continue entertaining activities by selecting his or her prize using crane arm 102 and crane controls 103 and 110, which control the movement of crane arm 102 using crane motor components 104-105. As the player positions crane arm 102 over the desired prize, for example, prize 108, he or she deploys crane arm 102 by actuating crane control 110. Crane arm 102 deploys, lowering in the direction of prize 108 and, using the grabbing arms of crane arm 102, grabs prize 108. Crane arm 102 then autonomously positions its grabbing arms holding prize 108 over prize chute 111. Once the position of crane arm 102 is over prize chute 111, processing unit 113 signals the grabbing arms to relax, releasing prize 108 into prize chute 111. The player may then retrieve prize 108 through prize access door 112. If crane arm 102 fails to successfully grab the prize, prize sensor 115 will detect no prize entering prize chute 111. Prize sensor 115 transmits a signal to processing unit 113 indicating that a prize was not successfully dispensed, after which processing unit 113 will continue providing control of crane arm 102 to the player through crane controls 103 and 110. The player will, thus, maintain control over crane arm 102 until prize sensor 115 detects that a prize has been successfully dispensed.

Independent crane-based prize-dispensing games are well known in the art. A main part of the game play of existing crane-based prize-dispensing games is the uncertain probability of successfully grabbing a prize. Game operators may set electronic or mechanical parameters on a crane-based prize-dispensing game to make it more or less likely that a player will successfully win a prize. However, players of such existing crane-based prize-dispensing games are not guaranteed a prize. The crane manipulation process of such independent crane-based games is the primary game method, and the success or failure of the game object (i.e., to successfully grab a prize) is largely dependent on the operational parameters of the crane assembly set by the game operator.

Additional existing games that use a crane assembly provide for an underlying primary game and a secondary crane game that is activated when the player fails to successfully achieve the object of the primary game. Examples of such secondary crane games include providing a chance for the player to grab one or more pieces of candy or sweets provided in the game console display area. In such game units, the crane assembly is used as a secondary, alternative game which is only activated when the player fails to "win" the primary game. Such secondary crane games may also be set to always provide at least one piece of candy to the losing player. However, in such game systems, the sweets or candy are a consolation prize available when the player loses the underlying primary game.

In the embodiment of the present teachings of FIG. 1, the crane arm 102 is used as the dispensing mechanism for the prize awarded by successfully completing the objective of the primary game. Therefore, because a player of direct prize-dispensing game 10 wins the underlying game prior to having access to crane arm 102 to dispense a prize, the player is guaranteed that crane arm 102 will successfully grab a prize. When positioning crane arm 102 over the desired prize, prize 108, the player may not accurately place crane arm 102 in the location that will successfully grab prize 108. In this instance, when deployed, crane arm 102 will not grab prize 108. As noted, prize sensor 115 detects that no prize has been successfully dispensed. When no prize is detected, control of crane arm 102 is again returned to crane control 102 by processing unit 113, such that the player may continue to position crane arm 102 over the desired prize for another attempt. The player may even change his or her mind with regard to the prize he or she desires. For example, the player may then use crane control 103 to re-position crane arm 102 over prize 109. As the player actuates crane control 110, crane arm 102 once again deploys attempting to successfully grab prize 109. If successful, crane arm 102 will dispense prize 109 into prize chute 111, thus, triggering prize sensor 115 to indicate a successful prize dispensing, and ceasing player-control to crane arm 102. However, if the attempt is again unsuccessful, prize sensor 115 will again signal processing unit 113 to keep crane control 110 active until a prize is successfully dispensed to the player. In contrast, when a prize is not successfully secured or grabbed in an independent crane-based prize-dispensing game, the player's turn is ended.

It should be noted that in additional or alternative embodiments of the present teachings, sensors may be placed directly in crane arm 102 that sense whether or not a prize has been successfully grabbed. These in-arm sensors may be used alternatively to prize sensor 115 or in conjunction with prize sensor 115, to guard against a prize that was successfully grabbed, but which may have been dropped from crane arm 102 before reaching prize chute 111.

By providing the crane mechanism as the prize dispenser, direct prize-dispensing game 10 provides an additional entertaining user experience for a player. The player is entertained first by playing the underlying game, and then the entertainment continues when the player is provided the opportunity to choose his or her own prize by manipulating crane arm 102 to retrieve this prize. The user experience is, therefore, maximized by continuing the entertainment even after the underlying game play has ceased because of a player win.

Returning again to FIG. 1, an alternative embodiment of direct prize-dispensing game 10 allows for the player to continue using crane arm 102 for a predefined period of time once the player successfully achieves the predetermined objective of the underlying game. Therefore, instead of allowing the player to select only one prize using crane arm 102, a timer is started and displayed to the player on game screen 100. As the timer counts down, the user is able to use crane controls 103 and 110 to manipulate crane arm 102 to grab as many prices as possible before the timer expires. Once the timer expires, any prize granted by crane arm 102 will be released. If crane arm 102 were not over prize chute 111, the grab prize will fall back into prize area 106. In this embodiment of the present teachings, the player's experience is enhanced with a level of excitement added to the prize redemption process implemented through crane arm 102.

For a firmware and/or software implementation, the methodologies may be implemented and controlled with modules (e.g., procedures, functions, and so on) that direct the performance of the functions described herein. Any machine or computer readable medium tangibly embodying instructions may be used in implementing the methodologies described herein. For example, software code may be stored in a memory and executed by a processor. When executed by the processor, the executing software code generates the operational environment that implements the various methodologies and functionalities and controls the mechanical elements of the different aspects of the teachings presented herein. Memory may be implemented within the processor or external to the processor. As used herein the term "memory" refers to any type of long term, short term, volatile, nonvolatile, or other memory and is not to be limited to any particular type of memory or number of memories, or type of media upon which memory is stored.

The functionality of the underlying game as well as the functionality of the crane operation of crane arm 102 is defined in software code executed by processing unit 113 of direct prize-dispensing game 10. The software code may be stored in local memory of processing unit 113 as firmware, or may be stored in external memory 114, which is coupled to the processing unit 113. Both the local memory of processing unit 113 and external memory 114 are computer readable media capable of storing electronic information and program or software code. When executed by the processing unit 113, the software code activates the electronics and mechanical motors that implement the underlying game play as displayed on game screen 100 and receive input from the player through game control 101 and crane controls 103 and 110, as well as the mechanical motion and deployment of crane arm 102 with crane motor components 104-105.

The machine or computer readable medium that stores the software code defining the methodologies and functions and controlling the mechanics described herein includes physical computer storage media. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer. As used herein, disk and/or disc includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer readable media.

Figure 2:
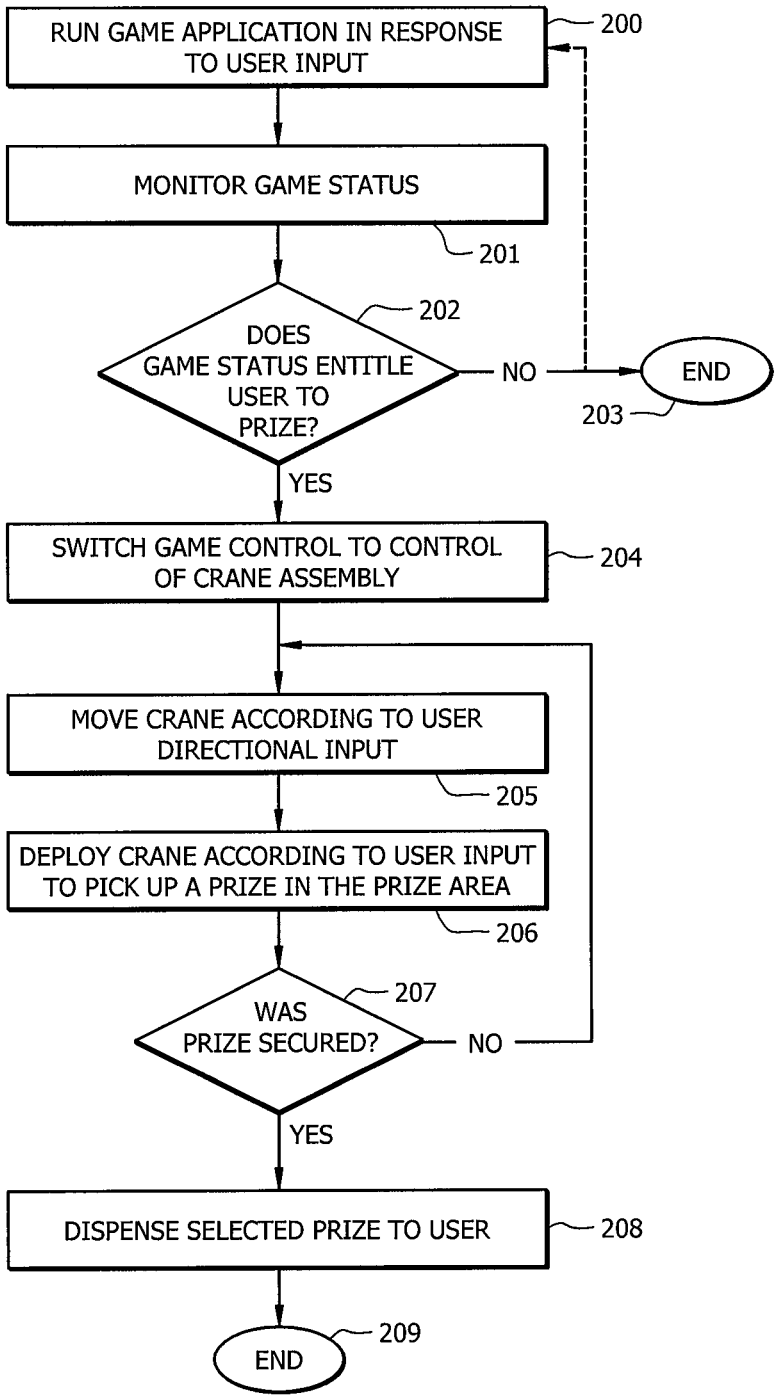
FIG. 2 is a flowchart illustrating example functional blocks executed to implement on embodiment of the present teachings.

FIG. 2 is a flowchart illustrating example functional blocks executed to implement one embodiment of the present teachings. In block 200, a game application is run in response to user input. Game status is monitored in block 201. A determination is made, in block 202, whether or not the status of the game entitles the user to a prize. If not, game play ends in, block 203, or, alternatively, game play continues with the running game application in block 200. If the game status does entitle the user to a prize, the game control is switched, in block 204, to control of the crane assembly. A crane assembly is moved, in block 205, according to user directional input. In response to input received from the user, the crane is deployed, in block 206, to pick up a prize in the prize area. In block 207, a determination is made whether the prize was actually secured in the crane arms. This determination may be implemented using sensors in the crane arm, sensors in a prize dispensing chute, or some combination of both. If the prize is determined not to have been secured, the user is able to continue moving the crane in block 205. Otherwise, if the prize was successfully secured in the crane arms, the selected prize is dispensed to the user in block 208. Once the prize is dispensed, operation of the game ends in block 209.

Figure 3:
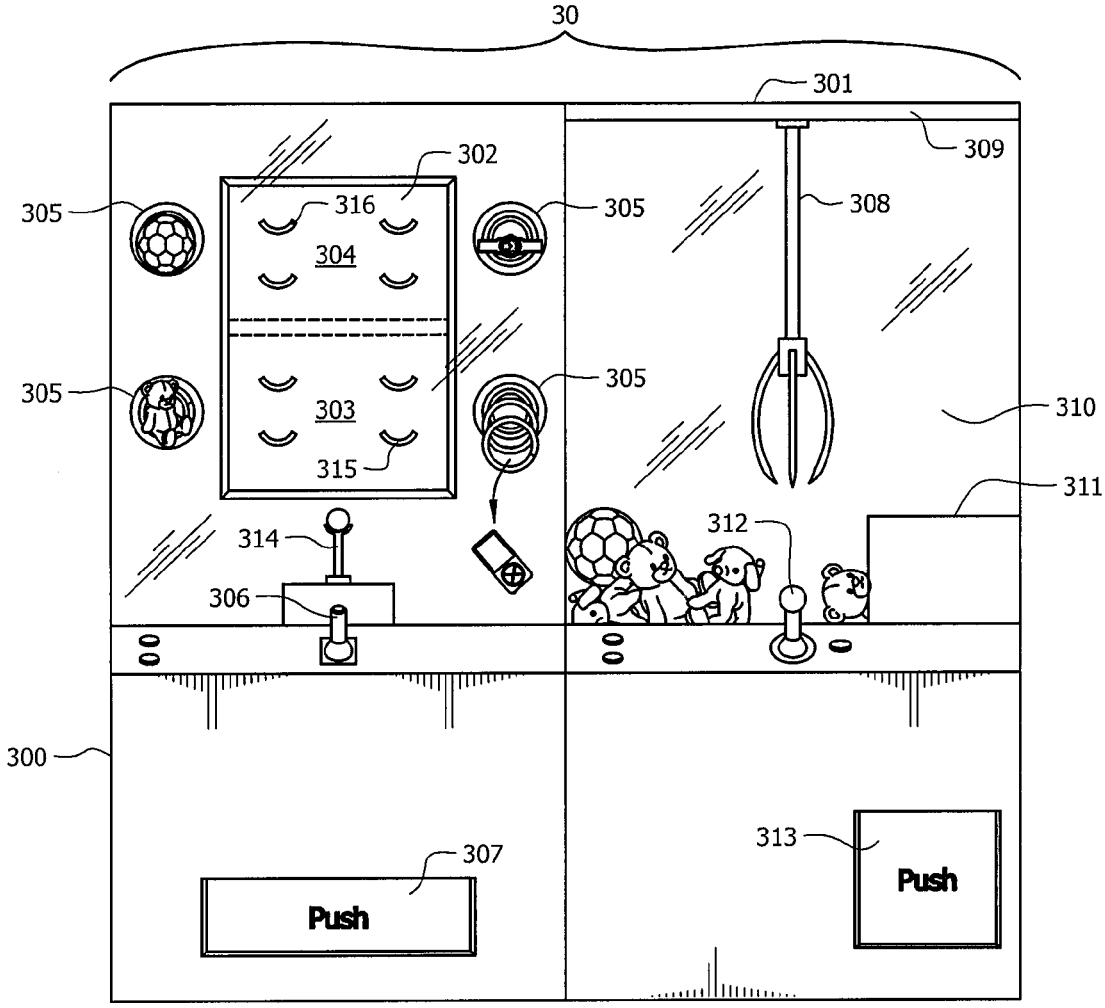
FIG. 3 is a diagram illustrating a prize-dispensing game configured according to one embodiment of the present teachings.

The various embodiments of the present teachings may be implemented in a variety of different configurations. FIG. 3 is a diagram illustrating prize-dispensing game 30 configured according to one embodiment of the present teachings. Prize-dispensing game 30 is configured having two adjacent sections: game play section 300 and crane dispenser section 301. The game presented in game play section 300 provides two prize levels. The two levels are represented on game field 302 as minor prize level 303 and major prize level 304. The user manipulates game controller 306 to interact with the game. The underlying game of prize-dispensing game 30 provides for the user to mechanically participate. By manipulating game controller 306, a swing arm 314 is actuated allowing the user to interact physically within minor prize level 303 and major prize level 304. Minor prize level 303 and major prize level 304 include minor prize mechanical game pieces 315 and major prize mechanical game pieces 316. Therefore, the underlying game in prize-dispensing game 30 is a mechanical game. Game play section 300 also includes prize dispensing arms 305. If the user successfully completes the objects for major prize level 304, a major prize, suspended via prize dispensing arms 305, is dropped into a prize dispenser accessible by prize door 307. If the user only successfully completes the objects for minor prize level 303, control of prize-dispensing game 30 is switched from game play section 300 to crane dispenser section 301.

Crane dispenser section 301 includes crane arm 308, which moves along a crane track assembly 309. Crane track assembly 309 includes various motors for controlling the motion of crane arm 308, as well as the manipulation of the grabbing arms of crane arm 308. Prize container 310 provides a location visible to the user for minor prizes to be located. Crane control 312 provides a user interface that allows the user to direct the movement of crane arm 308. The user directs crane arm 308 over a specific portion of prize container 310, such that the grabbing arms of crane arm 308 are directly above a desired prize. When the user deploys crane arm 308, crane arm 308 lowers the grabbing arms to the lower location of prize container 310. If the user has positioned crane arm 308 correctly, the grabbing arms will collapse upon the desired prize, allowing the prize to be picked up by crane arm 308. Crane arm 308 then moves the prize above prize chute 311 and drops the prize into prize chute 311. The user may then access the prize through prize door 313.

It should be noted that, in additional or alternative embodiments of the present teachings, prize container 310 may provide the location for the major prizes to be selected by the user using crane arm 308, while minor prizes are suspended via prize dispensing arms 305. The scope and spirit of the present teachings are not limited to any one particular implementation or arrangement of prizes.

Figure 4:
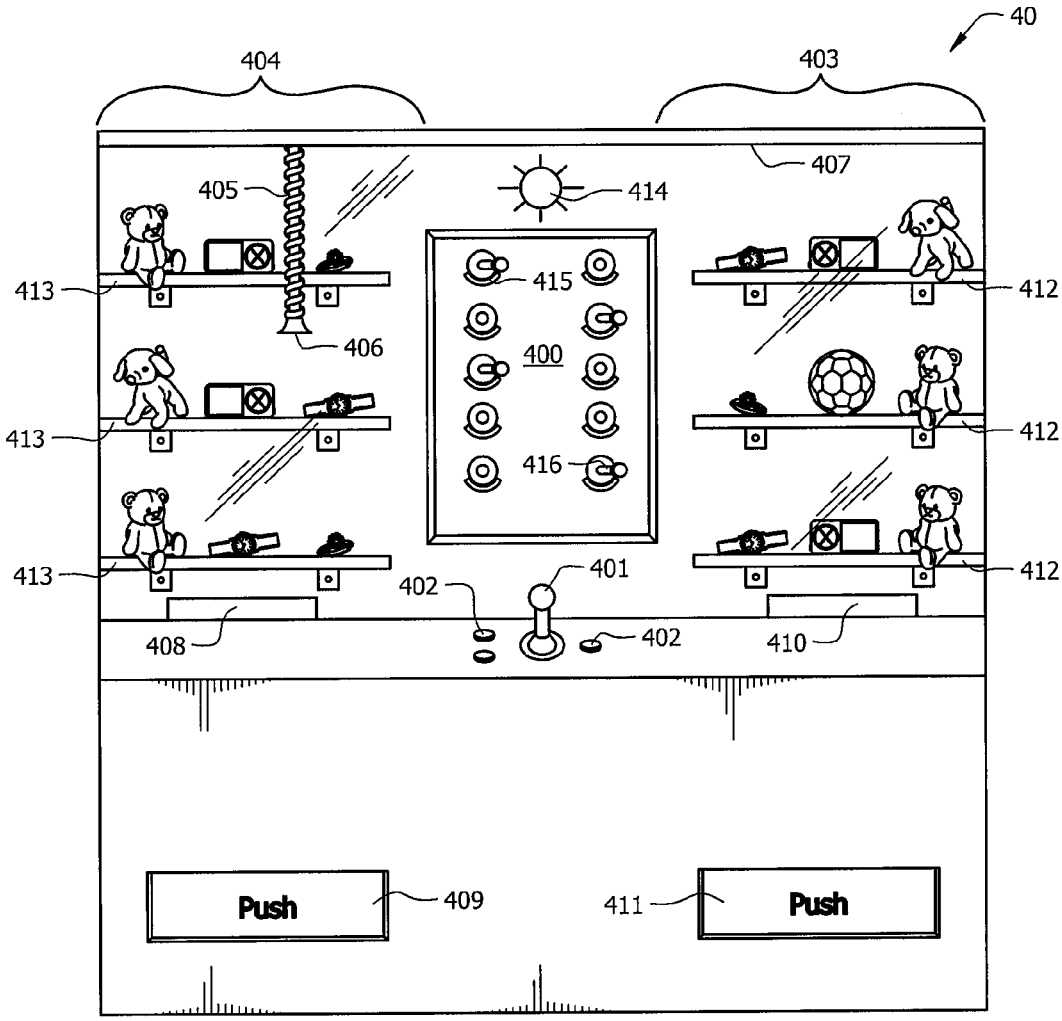
FIG. 4 is a diagram illustrating a direct prize-dispensing game configured according to one embodiment of the present teachings.

FIG. 4 is a diagram illustrating prize-dispensing game 40 configured according to one embodiment of the present teachings. Prize-dispensing game 40 displays the visual representation of its underlying game onto game field 400. The user interacts with the game through game controls 401-402. The underlying game in prize-dispensing game 40 is another mechanical game. In this mechanical game, the user controls crane arm 405 to maneuver game pegs 416 into and out of peg holes 415. Therefore, crane arm 405 is also used as a part of the underlying game, but is not associated with any prize dispensing during game play. For purposes of the embodiment depicted in FIG. 4, the underlying game offers multiple different levels of prizes depending on the user's play of the underlying game. Prize-dispensing game 40 is divided into prize level sections 403-404. Prizes located within prize level section 403 have varying values between a first range, while the prizes located within prize level section 404 have varying values between a second range. The value range of the prize that the user may eventually be entitled to will depend on how well the user participates in the underlying game. When the underlying game is completed or has reached a point at which the user is entitled to a prize, prize-dispensing game 40 switches control over to the crane assembly to dispense the prize.

The crane assembly of prize-dispensing game 40 includes crane arm 405, crane receptacle 406, and crane motor components 407. The crane assemblies described with respect to the previous example embodiments in FIGS. 1 and 3 all reflected a crane that operates using various numbers of grabbing arms to physically grasp the desired prize. However, the crane structures compatible with the various embodiments of the present teachings are not limited to such types. The crane assembly depicted in FIG. 4 operates using pneumatic pressure. A hose is included with crane arm 405 which is attached at one end to crane receptacle 406 and attached at the other end to an air compressor motor (not shown). When the crane assembly is deployed to pick up a selected item, the air compressor motor creates a suction through the hose to crane receptacle 406. Thus, when crane receptacle 406 is placed onto a prize within either of prize level sections 403-404, the suction will cause the prize to adhere to crane receptacle 406. When crane arm 405 is thereafter positioned over one of prize chutes 408 and 410, the air compressor is stopped, thereby ending the suction and releasing the adherence of the selected prize to crane receptacle 406. As a result, the prize will fall into the particular one of prize chutes 408 and 410, and the user will be able to access the prize through the corresponding one of prize access doors 409 and 410.

Because prize-dispensing game 40 offers multiple prize levels, a system for differentiating the available prizes for selection will be included. Any various number of different prize differentiating means may be implemented without departing from the scope of the present teachings. For purposes of example only, one type of system will be described with respect to the embodiment described in FIG. 4. The prizes contained within prize-dispensing game 40 are divided into different shelves 412-413. Each higher value prize includes a tag incorporating a radio frequency identifier (RFID). As crane arm 405 lowers and engages the selected prize with crane receptacle 407, the RFID tag is read by an RFID reader embedded in crane receptacle 406. Should the prize value exceed the level of prize available to the user, the RFID reader transmits a signal which causes the air compressor to halt, thus, dropping the prize back in place. The user may be notified of the incorrect prize selection through game light 414. Game light 414 will be lit when an incorrect prize selection is made. Therefore, the user is only capable of selecting and retrieving a prize within the value he or she is entitled.

In an alternative embodiment of the present teachings illustrated in FIG. 4, the prize dispensing functionality of prize-dispensing game 40 is modified to provide a user with a predefined period of time in which to select multiple prizes with crane arm 405. When the user successfully achieves the predetermined objective of the underlying game, a timer is started by prize-dispensing game 40. During this predefined time, the user may manipulate crane arm 405 to select as many qualified prizes as possible. Instead of displaying the actual time to the user, game light 414 is used to indicate timing. As the prize dispensing time begins, game light 414 will be eliminated. When the time period nears its end, game light 414 will begin to flash. The flashing will indicate to the user that the selection time is about to run out. Once the time period ends any prize captured by a crane arm 405 will be dropped. If not situated over either of prize chutes 408 or 410, the dropped price will remain within prize-dispensing game 40.

It should be noted that in additional and/or alternative embodiments of the present teachings, different crane mechanisms may be used. In addition to the grabbing arm mechanism and pneumatic cranes, crane mechanisms may also include magnetic components, adhesive components, piercing components (such as hooks or pins), and the like. The various embodiments of the present teachings are not limited to any particular type of crane mechanism. Moreover, any different type of game may form the basis of the underlying game offered by the direct prize-dispensing game. Games that are electronic or computer controlled, mechanical games, games involving the crane arm, and the like. The various embodiments of the present teachings are also not limited to any particular type of underlying game.

Although the present teachings and its advantages have been described in detail, it should be understood that various changes, substitutions and alterations can be made herein without departing from the spirit and scope of the present teachings as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present teachings, processes, machines, manufacture, compositions of matter, means, methods, or steps, presently existing or later to be developed that perform substantially the same function or achieve substantially the same result as the corresponding embodiments described herein may be utilized according to the present teachings. Accordingly, the appended claims are intended to include within their scope such processes, machines, manufacture, compositions of matter, means, methods, or steps.

What is claimed is:

1. A method for dispensing a prize in an prize-dispensing game, said method comprising:

monitoring a game status of an active game on said prize-dispensing game, wherein participation in the active game is not associated with dispensing of said prize;

responsive to said game status indicating a player is entitled to said prize, switching player control of said prize-dispensing game to a crane apparatus associated with dispensing said prize;

positioning said crane apparatus according to directional input received from said player;

receiving from said player, deployment input for said crane to secure said prize;

responsive to a failure to secure said prize, maintaining player control of said prize-dispensing game with said crane apparatus until said prize is dispensed such that said prize is guaranteed to said player; and responsive to a success to secure said prize, dispensing said secured prize to said player.

2. The method of claim 1 wherein said game status indicates a value level for said prize, said method further comprising one of:

restricting movement of said crane apparatus to a location within said prize-dispensing game reserved for one or more prizes having said value level; and prior to said dispensing, verifying said secured prize does not exceed said value level.

3. The method of claim 2 wherein said verifying comprises:

sensing an information tag associated with said secured prize;

in response to said information tag indicating a value of said secured prize within said value level, performing said dispensing of said secured prize; and in response to said information tag indicating said value exceeds said value level, releasing said secured prize back to said prize-dispensing game.

4. The method of claim 1 further comprising:

sensing said crane apparatus to verify securing of said prize; and removing said player control from said crane apparatus responsive to said dispensing.

5. The method of claim 4 wherein said sensing is implemented by one or more of:

a crane arm prize sensor located in said crane apparatus; and a dispenser prize sensor located in a prize chute used for dispensing said prize to said player.

6. The method of claim 1 further comprising:

in response to said switching player control of said prize-dispensing game to said crane apparatus, beginning a timer;

maintaining player control of said crane apparatus until said timer reaches a predefined time period; and in response to said timer reaching said predefined time period, ceasing player control of said crane apparatus.

7. The method of claim 6 further comprising:

in response to said timer reaching said predefined time period, determining that at least one secured prize has been dispensed to said player; and in response to said determining failing to identify at least one secured prize being dispensed to said player, prior to said ceasing, continuing player control of said crane apparatus until said at least one secured prize has been dispensed to said player.

8. The method of claim 6 further comprising:

displaying an indicia of said timer counting to said predefined time period to said player.

* * * * *